US005691735A

United States Patent [19]

Butland et al.

[11] Patent Number: 5,691,735

[45] Date of Patent: Nov. 25, 1997

[54] DIPOLE ANTENNA HAVING COUPLING TABS

[76] Inventors: Roger John Butland, 6 Atwood Grove, Churton Park, Wellington 6004, New Zealand; William Emil Heinz, 47 Beazley Avenue, Wellington 6004, New Zealand

[21] Appl. No.: 715,767

[22] Filed: Sep. 19, 1996

Related U.S. Application Data

[63] Continuation of Ser. No. 379,639, filed as PCT/NZ93/00064, Aug. 6, 1993, abandoned.

[30] Foreign Application Priority Data

Aug. 7, 1992 [NZ] New Zealand ..... 243877

[51] Int. Cl.[6] ..... H01Q 9/16; H01Q 9/28

[52] U.S. Cl. ..... 343/795; 343/793

[58] Field of Search ..... 343/793, 795, 343/878; H01Q 9/28

[56] References Cited

U.S. PATENT DOCUMENTS 4,513,292 4/1985 Bowman ..... 343/795

4,814,783 3/1989 Shelton et al. ..... 343/795

4,825,220 4/1989 Edward et al. ..... 343/795

FOREIGN PATENT DOCUMENTS 0073177 4/1988 Japan ..... 343/795

*Primary Examiner*—Donald T. Hajec

*Assistant Examiner*—Tan Ho

*Attorney, Agent, or Firm*—Merchant, Gould, Smith, Edell, Welter & Schmidt, P.A.

[57] ABSTRACT

A dipole having radiating elements (9, 14) which taper from the proximal end (1) of the radiating element to the distal end (2) of the radiating element. Electrical coupling is provided between adjacent lateral edges of the radiating elements by means of spaced apart tabs (10, 11, 12, 13). Cut-away portions (5, 5*a*) are provided between the proximal end (1) and the tabs (3, 4). By adjusting the distance between and the extent to which the tabs (10, 11, 12, 13) overlap the real part of the impedance of the dipole may be adjusted. The dipole may thus be configured to be directly driven from a feed-line without requiring matching components. This results in reduced complexity and losses. The dipole also exhibits reduced impedance variation, increasing the bandwidth of the dipole.

20 Claims, 4 Drawing Sheets

DIPOLE ANTENNA HAVING COUPLING TABS

This is a Continuation of application Ser. No. 08/379,639, filed as PCT/NZ93/00064 Aug. 6, 1993, now abandoned.

TECHNICAL FIELD

The present invention relates to a dipole. The radiating elements of the antenna have a novel shape with electrical coupling being provided between adjacent lateral edges of the radiating elements.

BACKGROUND OF THE INVENTION

To the present time various radiating elements have been used in dipole antennas ranging from cylindrical radiating elements to planar radiating elements such as the "bow tie" dipole. The radiating elements of the "bow tie" dipole antenna increase in width from the antenna drive point to the distal ends of the radiating elements. Conventional analysis suggests that best performance will be obtained when the radiating elements increase in width from the drive point to their distal ends.

Conventional thinking also suggests that matching should be effected at the antenna drive point. Dipole antennas incorporating known radiating elements have however suffered from relatively large impedance variations, restricting the bandwidth of the dipole antenna. Further, it has been difficult to adjust the resistive part of the impedance of a dipole antenna, resulting in the need for complex matching and incurring matching losses.

DISCLOSURE OF THE INVENTION

It is an object of the present invention to provide a dipole and radiating elements therefor which overcome at least some of the aforegoing disadvantages, or to at least provide the public with a useful choice.

According to one aspect of the invention there is provided a dipole having first and second radiating elements, the proximal ends of said radiating elements being connected to respective terminals of a drive point, the distal ends of said radiating elements extending outwardly from said drive point, characterised in that electrical coupling is provided between adjacent lateral edges of said first and second radiating elements towards the proximal ends of said radiating elements.

Preferably electrical coupling is provided between both lateral edges of the radiating elements in the form of spaced apart tabs connected to respective lateral edges of the radiating elements. The radiating elements preferably taper from the proximal end to the distal end thereof. Preferably, cut-away portions are provided between the tabs and the proximal ends of the radiating elements.

BRIEF DESCRIPTION OF THE DRAWINGS

The invention will now be described by way of example with reference to the accompanying drawings in which.

BEST MODE FOR CARRYING OUT THE INVENTION

Figure 1:
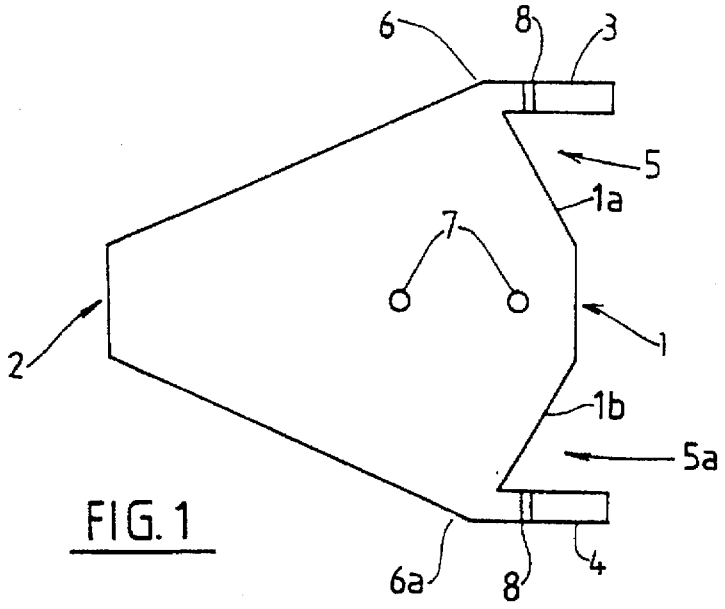
FIG. 1: shows the preferred form of radiating element.

Referring to FIG. 1 the preferred form of radiating element according to the invention is shown. The radiating element is of generally diamond shape having truncated proximal and distal ends, 1 and 2 respectively. Tabs 3 and 4 are provided proximate the lateral edges 6,6*a* of the radiating element towards the proximal end thereof. The tabs 3 and 4 step up or down relative to the plane of the radiating element at transitions 8. Cut-away portions 5 and 5*a* are provided between the proximal end and the respective tabs 3 and 4. These cut-away portions are preferably angled away from the proximal end towards the distal end of the radiating element. Apertures 7 may be provided to secure a terminal 15 (see FIG. 3) to the radiating element.

Figure 3:
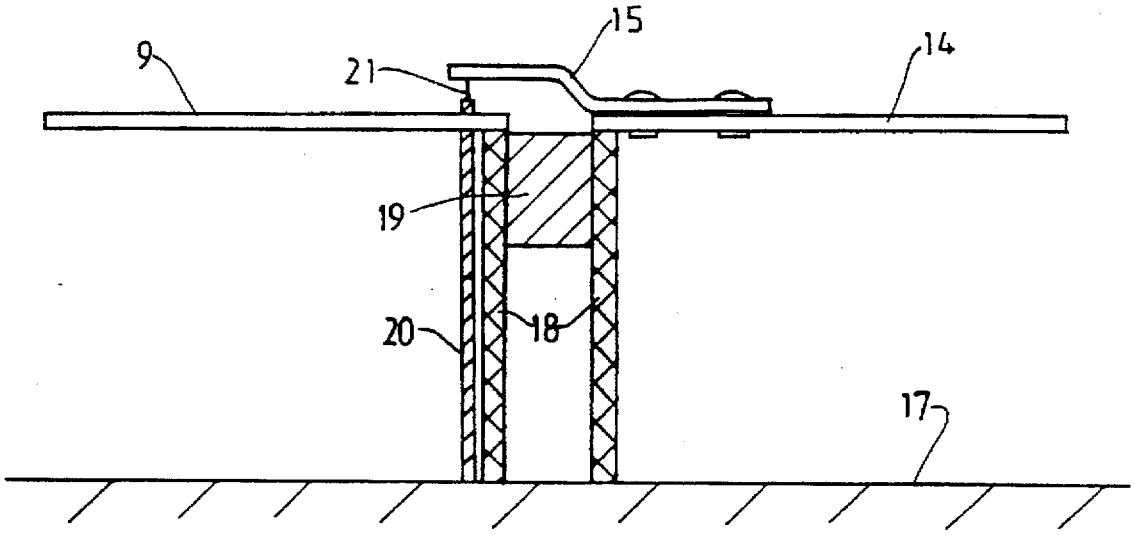
FIG. 3: shows a cross-sectional side view of the feed arrangement to the dipole shown in FIG. 2.
Figure 2:
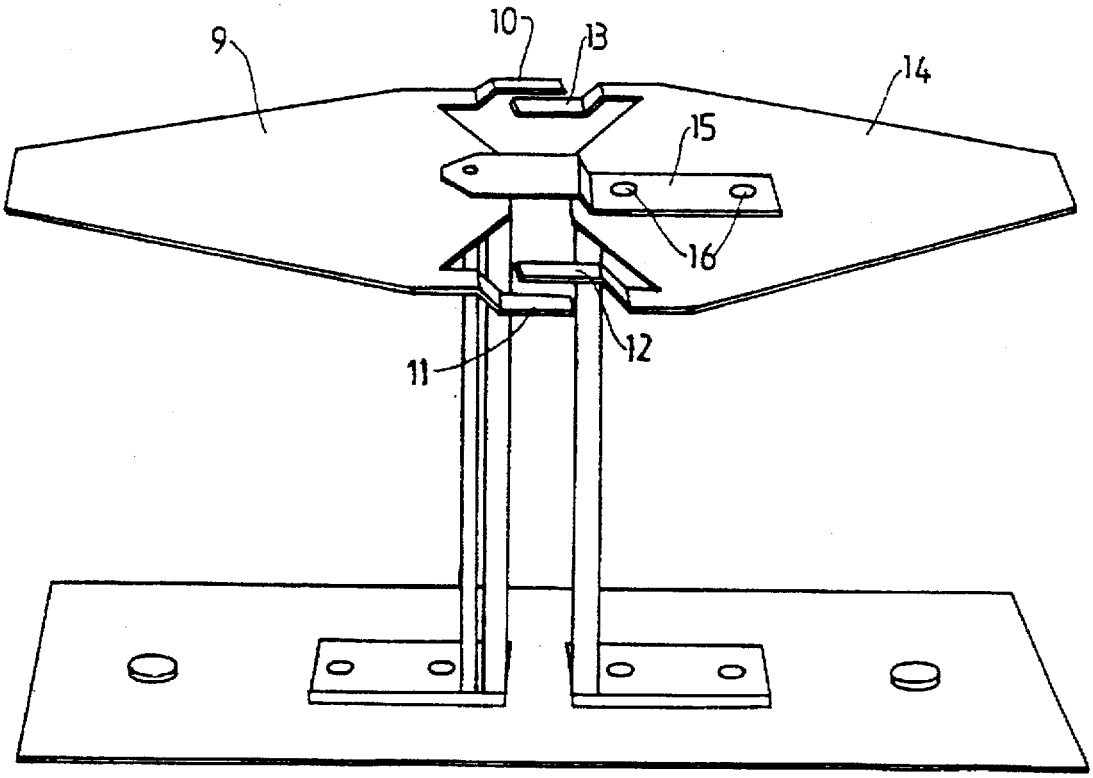
FIG. 2: shows a perspective view of a dipole incorporating two radiating elements of the form shown in FIG. 1.

Referring now to FIG. 2 a dipole antenna incorporating two radiating elements of the form shown in FIG. 1 is shown in perspective. FIG. 3 is a side cross-sectional view showing the feed arrangement of the antenna shown in FIG. 2. Radiating elements 9 and 14 are supported above a ground plane 17 by stand-offs 18. Stand-offs 18 provide the mechanical support for radiating elements 9 and 14 as well as electrically connecting the radiating elements to the ground plane 17.

Feed-line 20 supplies the driving signal to radiating elements 9 and 14. The external conductor of feedline 20 is electrically connected to radiating element 9 and ground plane 17. The central conductor 1 is electrically connected to terminal 15 at the drive point. A dielectric block 19 may be provided between stand-offs 18 for mechanical stability and matching purposes. Terminal 15 may be secured to radiating element 14 by suitable fastening means 16.

Referring again to FIG. 2 it will be seen that the tabs 10 and 11 of radiating element 9 are off-set with respect to the plane of radiating element 9. Tabs 12 and 13 of radiating element 14 are likewise offset with respect to the plane of radiating element 14. The pairs of tabs 11 and 12 and 10 and 13 overlap to provide electrical coupling between the adjacent lateral edges of the radiating elements. Adjustment of this "electrical coupling" enables the real part of the drive point impedance to be adjusted. By altering the degree to which the tabs overlap and the space between the tabs the real part of the drive point impedance of a dipole can be adjusted to a desired magnitude. The susceptive (i.e. imaginary) part of the drive point admittance can be adjusted by varying the drive point capacitance or the length of standoffs 18. For the embodiment shown in FIG. 3 the drive point capacitance may be varied by bending terminal 15 closer to radiating element 9 or by altering the size of dielectric block 19. The drive point admittance can additionally be varied by positioning a short circuit between the transmission stand-offs 18 at the required height.

The applicant has found that by providing impedance matching by way of tabs on the lateral edges of the radiating elements the impedance variation at the dipole drive point is decreased. This results in an increased useable bandwidth for the dipole antenna. Matching in this way also allows the real part of the impedance of a dipole to be reduced, making matching easier and reducing feed losses. Where a single dipole is used the dipole may be directly connected to a driving signal without matching (the real part of the impedance can be brought close to 50 ohms by adjusting the tab positions). Contrary to conventional practice the radiating element of the present invention tapers from the proximal end to the distal end thereof. The distal end is preferably less than half the width of the proximal end (i.e between lateral edges 6 and 6*a*). More preferably the distal end is about a quarter the width of the radiating element at the proximal end. The cut-away portions 5 and 5*a* between the tabs and the proximal end 1 give improved performance. Cutaway portions 5 and 5*a* are preferably of the triangular shape shown. The proximal edges 1*a* and 1*b* are preferably inclined towards the distal end of the radiating element.

Figure 4A:
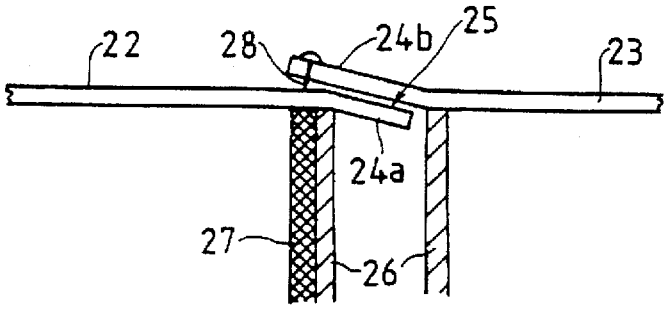
FIG. 4*a*: shows an alternative feed arrangement to that shown in FIG. 3.
Figure 4B:
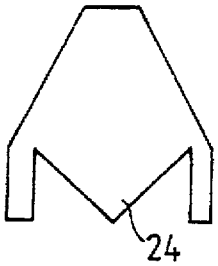
FIG. 4*b*: shows the shape of the radiating element used in the embodiments shown in figures 4*a* and 5.

Referring now to FIGS. 4*a* and 4*b* an alternative feed arrangement is shown. In this embodiment the proximal ends of the radiating elements 24*a* and 24*b* have been extended to form a point 24 (see FIG. 4*b* ). The points 24*a* and 24*b* overlap at the drive point between the stand-offs to provide a susceptance control gap 25. The distance between points 24*a* and 24*b* can be adjusted to provide appropriate susceptive compensation. The external conductor of feed-line 27 is electrically connected to radiating element 22 and the central conductor 28 is connected to point 24*b* of radiating element 23.

Figure 5:
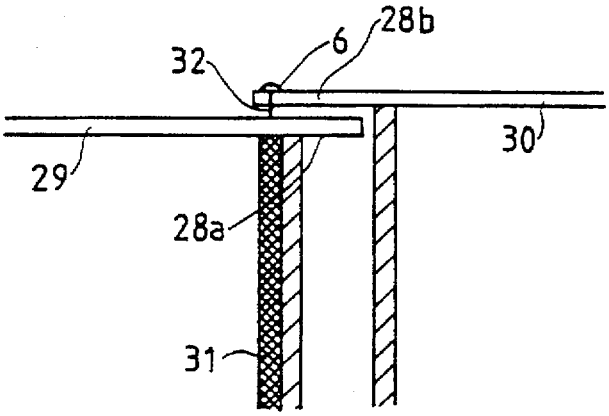
FIG. 5: shows a further alternative feed arrangement.

Referring now to FIG. 5 an alternative feed arrangement is shown. The radiating elements used in this embodiment are of the same shape as shown in FIG. 4*b*. In this case rather than bending the points 24*a* and 24*b* as in FIG. 4*a* the points 28*a* and 28*b* overlap. This means that radiating elements 29 and 30 do not lie in the same plane (as in the embodiment shown in FIG. 4*a*). The external conductor of feed-line 31 is connected to radiating element 29 and the central conductor 32 is connected to point 28*b* of radiating element 30. To achieve a better radiation pattern in the far field radiating element 30 may be angled slightly down from its proximal end to its distal end and radiating element 29 may be angled slightly up from its proximal end to its distal end. In this way the average height of each radiating element above the ground plane may be substantially the same.

Figure 6:
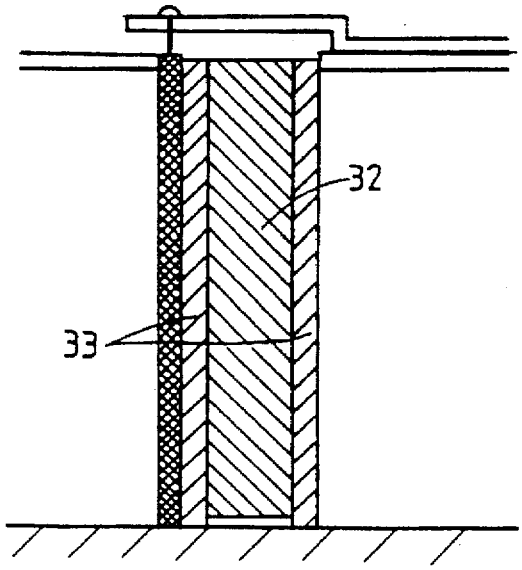
FIG. 6: shows an alternative feed arrangement for use in compact antennas.

Referring now to FIG. 6 an embodiment for use in compact antennas is shown. The dipole shown in figure 6 is of the same general construction as the dipole shown in FIGS. 2 and 3. In this case however a greater volume of dielectric 32 has been provided between stand-offs 33. Dielectric 32 may be shaped to fit the entire or any fraction of the space between supports 33 depending on the required shortening of the stand-offs 33. The shortening factor is inversely proportional to the square root of the dielectric constant. Shortening in this manner enables the stand-offs 33 to be reduced in length whilst still maintaining a quarter wavelength electrical balun section.

Figure 7:
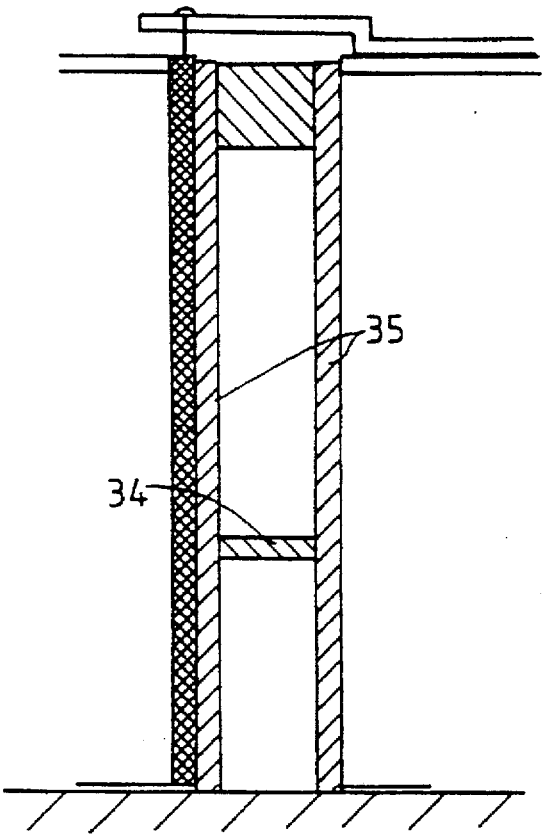
FIG. 7: shows an alternative feed arrangement to increase the height of a dipole above the ground plane for beam width adjustment.

FIG. 7 shows an alternative feed arrangement in which the dipole is raised higher than usual above the ground plane. Normally, the radiating elements are positioned a quarter wavelength above the ground plane. In some cases however it is desirable to increase the height of the dipole above the ground plane for beam width adjustment. In this case a stub short circuit 34 is provided between stand-offs 35 at the position the ground plane would normally be (i.e.: so that the distance between the stub short circuit and the dipole is about a quarter wave length). The susceptive part of the drive point admittance can be adjusted by varying the position of stub 34.

Figure 8:
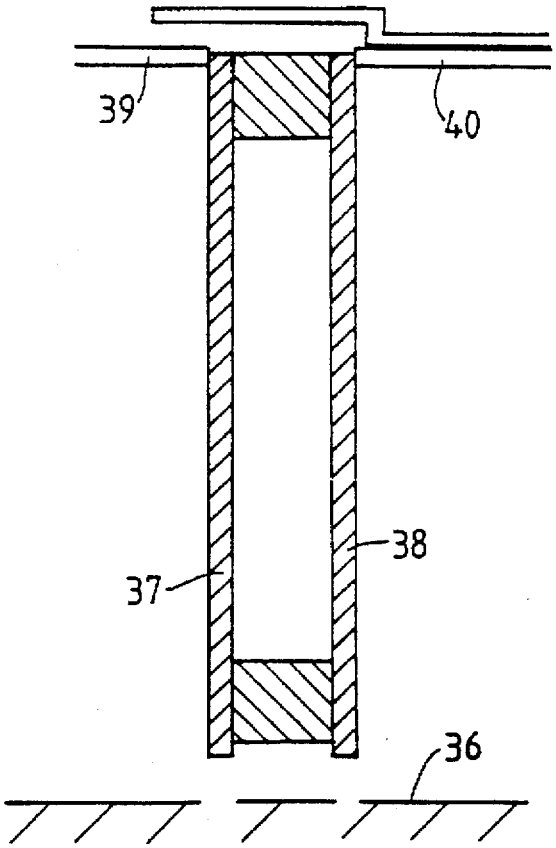
FIG. 8: shows an alternative feed arrangement in which the radiating elements are fed directly by the supports.
Figure 10:
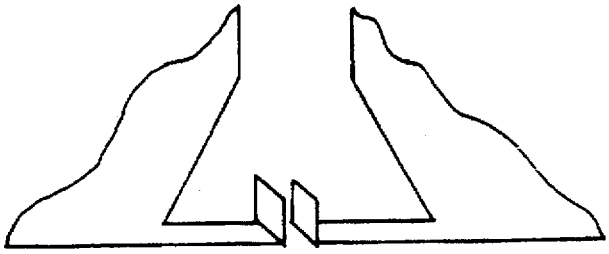
FIG. 10: shows an alternative coupling arrangement between the tabs of the radiating elements.

Referring now to FIG. 8 an embodiment is shown in which the dipole is fed directly via the stand-offs. This does away with the need for feed-line 20 shown in FIG. 3. By controlling the relative positions of the tabs and the drive point reactance of the dipole can be adjusted for 100 ohms balanced feed. In this case the stand-offs 37, 38 are electrically isolated from the ground plane 36. Stand-offs 37 and 38 are adjusted in size and spacing to form a 100 ohm transmission line. Stand-offs 37 and 38 are electrically connected to radiating elements 39 and 40. Stand-offs 37 and 38 may be directly connected to a 100 ohm feed-line which may also feed an adjacent dipole of a corporate feed assembly. The feeding junction of this interconnecting transmission line will be equivalent to 50 ohms. This enables the direct connection of a 50 ohm co-axial cable with a simple balun to feed the pair of dipoles, without requiring an impedance transformation. This reduces the cost of matching components and reduces power loss.

Figure 9:
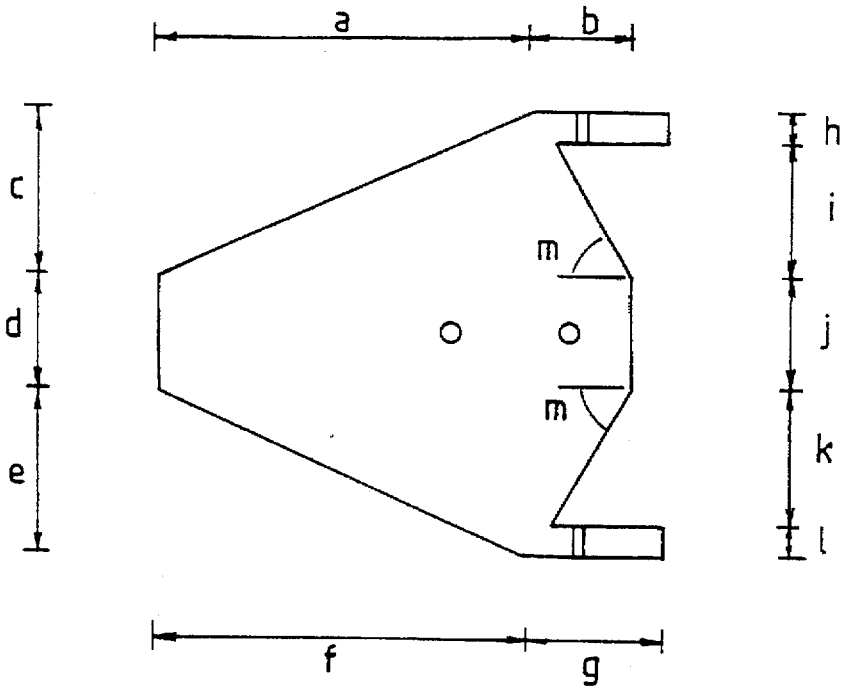
FIG. 9: indicates the dimensions of the preferred radiating element shown in FIG. 1.

Referring now to FIG. 9 the dimensions of the preferred radiating element are given below in table 1. The distances are given as fractions of the wavelength at the frequency of operation. It will be appreciated that these lengths will be scaled depending upon the frequency of operation. Angle m is the angle between the edge of the cut-away portions and the longitudinal direction of the radiating elements. Angle m will preferably be between 45° to 75°, most preferably m will be about 60°.

TABLE 1

| | | | |
|---|---|---|---|
| A | 0.18 L | G | 0.066 L |
| B | 0.048 L | H | 0.015 L |
| C | 0.08 L | I | 0.065 L |
| D | 0.053 L | J | 0.053 L |
| E | 0.08 L | K | 0.065 L |
| F | 0.18 L | L | 0.015 L |

Where L is the wavelength at the frequency of operation.

It is to be appreciated that the dipole of the present invention may be utilised in a number of antenna configurations. For example, the dipole of the invention may be incorporated into microstrip, matstrip or printed circuit board antennas. The radiating elements may be printed on opposite sides of a thin insulating board with the printed tabs overlapping. The board could be mounted above a ground plane with insulating material between the printed board and ground plane. It is to be appreciated that the dipole of the invention may find application in a wide range of antennas.

It will thus be seen that the present invention provides a dipole antenna in which both the real part of the drive point impedance and the susceptive part of the admittance can be varied. This makes matching simpler and results in lower losses. The dipole of the invention also has decreased impedance variation resulting in a dipole having a greater bandwidth.

Industrial Applicability

The dipole of the invention may find wide application in a number of antenna configurations. The dipole of the invention is suitable for use in wide bandwidth low loss antennas. The dipole of the invention may find particular application in panel antennas and other multi-element antennas.

We claim:

1. A dipole having first and second radiating elements with proximal and distal ends and lateral edges, the proximal ends of said radiating elements being connected to respective terminals of a drive point, the distal ends of said radiating elements extending outwardly from said drive point, and wherein reactive coupling is provided between said first and second radiating elements by spaced apart tabs positioned substantially at corners of the respective proximal ends and lateral edges of said radiating elements.

2. A dipole as claimed in claim 1 wherein the tabs comprise pairs of spaced apart tabs connected to said first and second radiating elements and which lie in substantially overlapping relationship.

3. A dipole as claimed in claim 2 wherein reactive coupling is provided between both lateral edges of both radiating elements.

4. A dipole as claimed in claim 2 wherein for each pair of tabs one tab is above and the other is below the plane of the respective radiating element.

5. A dipole as claimed in claim 4 wherein the radiating elements taper from the proximal ends to the distal ends thereof.

6. A dipole as claimed in claim 1 wherein the width of each radiating element at its distal end is less than half the width of the radiating element between its lateral edges towards its proximal end.

7. A dipole as claimed in claim 1 wherein the width of each radiating element at its distal end is about one quarter of the width of each radiating element between its lateral edges towards its proximal end.

8. A dipole as claimed in claim 1 wherein the radiating elements lie in substantially the same plane.

9. A dipole as claimed in claim 1 wherein the longitudinal axes of the radiating elements are generally co-axial.

10. A dipole as claimed in claim 1 wherein proximal edges extend from the proximal ends to the lateral edges and are inclined towards the distal ends of the radiating elements.

11. A dipole as claimed in claim 10 wherein the proximal edges of the radiating elements are inclined at an angle of about 45° to 75° to the longitudinal axes of each radiating element.

12. A dipole as claimed in claim 10 wherein the proximal edges of the radiating elements are inclined at an angle of about 60° to the longitudinal axes of each radiating element.

13. A dipole as claimed in claim 12 wherein the reactive coupling between said tabs provides for adjustment of the substantially real part of the drive point impedance.

14. A dipole as claimed in claim 1 wherein the proximal ends of the radiating elements overlap to provide susceptive compensation.

15. A dipole as claimed in claim 1 wherein the radiating elements are driven directly from a feed-line via stand-offs.

16. An antenna including two dipoles as claimed in claim 15 wherein the dipoles are driven from a common feed-line via respective standoffs.

17. A dipole as claimed in claim 1 wherein reactive coupling is provided between both lateral edges of both radiating elements.

18. An antenna including a dipole having first and second radiating elements with proximal and distal ends and lateral edges, the proximal ends of said radiating elements being connected to respective terminals of a drive point, the distal ends of said radiating elements extending outwardly from said drive point, and wherein reactive coupling is provided between said first and second radiating elements by spaced apart tabs positioned substantially at corners of the respective proximal ends and lateral edges of said radiating elements.

19. A dipole having first and second radiating elements, the proximal ends of said radiating elements being connected to respective terminals of a drive point, the distal ends of said radiating elements extending outwardly from said drive point, characterised in that reactive coupling is provided, between adjacent lateral edges of said first and second radiating elements towards the proximal ends of said radiating elements, by pairs of spaced apart tabs connected to respective lateral edges of said radiating elements, wherein said pairs of spaced apart tabs connected to said first and second radiating elements lie in substantially overlapping relationship.

20. A dipole as claimed in claim 19 wherein for each pair of tabs one tab is above and the other is below the plane of the respective radiating element.

* * * * *